US005887282A

United States Patent [19]

Lenhart

[11] Patent Number: 5,887,282

[45] Date of Patent: Mar. 30, 1999

[54] GLOVE WITH AN INTEGRATED HAND LOOP FOR POLES

[76] Inventor: Klaus Lenhart, Mittlerer Weg 23, D-73275 Ohmden, Germany

[21] Appl. No.: 990,432

[22] Filed: Dec. 15, 1997

[30] Foreign Application Priority Data

Nov. 25, 1997 [DE] Germany ..... 197 51 978.4

[51] Int. Cl.[6] ..... A63C 11/22; A41D 19/00

[52] U.S. Cl. ..... 2/159; 2/160; 2/161.1; 2/162; 2/917; 280/821

[58] Field of Search ..... 2/158, 159, 160, 2/161.1, 161.4, 162, 917; 280/821, 822, 809, 819

[56] References Cited

U.S. PATENT DOCUMENTS

| | | |
|---|---|---|
| 2,522,344 | 9/1950 | Carmin . |
| 3,170,703 | 2/1965 | Marchand . |
| 3,218,089 | 11/1965 | Marchand . |
| 3,232,632 | 2/1966 | Lewis . |
| 4,438,532 | 3/1984 | Campanella et al. . |
| 4,653,121 | 3/1987 | Kassal et al. . |
| 4,698,851 | 10/1987 | Dunford et al. . |
| 4,730,354 | 3/1988 | Saito . |
| 5,092,629 | 3/1992 | Bagneres et al. . |
| 5,110,154 | 5/1992 | Street . |
| 5,123,674 | 6/1992 | Bagneres et al. . |
| 5,328,205 | 7/1994 | Bacharach . |
| 5,516,150 | 5/1996 | Goode et al. . |

*Primary Examiner*—Michael A. Neas
*Assistant Examiner*—Shirra L. Jenkins
*Attorney, Agent, or Firm*—Jones, Tullar & Cooper, P.C.

[57] ABSTRACT

A glove with an integrated wrist strap for a pole, such as ski poles, cross-country poles, hiking sticks, walking sticks and the like has an upper surface that defines a palm side, a back side, a wrist part and a thumb joint part. The wrist strap is formed integrally with the glove and includes a circumferentially adjustable loop part that wraps around the wrist part, an attachment part which extends on the palm side of the glove in the region of the thumb joint part, and a pull tab which extends on the outside of the glove. Also included is a binding element which is attached to the attachment part and the pull tab. The binding element, the attachment part and the pull tab are located adjacent the thumb joint part on the palm side of the glove. The pull tab is embodied as at least partly elastic and secured releasably to the upper surface.

15 Claims, 4 Drawing Sheets

GLOVE WITH AN INTEGRATED HAND LOOP FOR POLES

BACKGROUND OF THE INVENTION

1. Technical Field

The present invention relates to a glove with an integrated wrist strap for poles, such as ski poles, cross-country poles, or hiking or walking sticks.

2. Background Art

In one such glove known from European Patent Disclosure EP-B1 0 357 517, the wrist strap is essentially disposed and fixed entirely inside the glove. Only the adjustable portion of the loop part and the binding element for connection to the grip of the pole or stick extend to the outside from the interior of the glove. In this way, whenever the glove is latched to the grip of the stick or pole, it is fixed directly to the grip, so that forces that are exerted, particularly in downhill skiing can be transmitted directly from the ski pole to the glove and vice versa. However, such a glove can be coupled only rigidly to the ski pole. In other words, with this combination of glove and grip, the pole can be grasped in only this one position. Grasping positions of the kind needed when hill climbing on skis or when pushing off in cross-country skiing are not possible.

U.S. Pat. Nos. 3,218,089 and 3,170,703 disclose a glove that in one embodiment has a likewise rigid, fixed binding to a ski pole in the form of a "floating skin" mounted between the thumb part and the index finger part. This produces the same immovable connection as mentioned above between the glove and the grip of the ski pole. In another embodiment mentioned in these patents, the glove is provided with a wrist strap that is relatively loosely threaded, which allows considerable freedom of motion of the glove relative to the ski pole grip. For instance, the skier can readily grasp the end of the ski pole grip with the glove, or can brace himself with his hand on the head of the ski pole grip. The ski pole grip can also be allowed to hang from the loop in such a way that it cannot be lost, to allow the skier to grasp some other article with his hand. With this known glove, however, as in the previously typical wrist straps that are separate from the glove, a firm, secure grasp of the ski pole that prevents the pole from slipping away and that offers a secure hold is not achieved.

SUMMARY OF THE INVENTION

An object of the present invention is therefore to create a glove with an integrated wrist strap for poles, such as ski poles, cross-country poles, or hiking or walking sticks, of the type referred to at the outset, which not only provides a more secure hold of a ski pole for the sake of direct force transmission, but also makes it possible to grasp the ski pole all the way around and to let it hang from the glove in such a way that it cannot be lost.

To attain this object, an attachment part and a pull tab are arranged to extend freely along the upper surface of the glove, and with the pull tab being embodied as at least partly elastic so that it can be secured releasably to the outside of the glove. This results in a glove with an integrated wrist strap of the type referred to at the outset.

With the provisions of the present invention, it is, on the one hand, attained particularly because of the elasticity of the pull tab, that the glove can be fixed firmly to the ski pole grip, and on the other that with the glove or its inner surface one can grasp the ski pole grip or in other words reach over its end, as is necessary for instance in climbing on skis or in hiking or in pushing off motions in cross-country skiing. Despite the secure hold of the grip on the stick or pole, the requisite freedom of motion required for other movements is still available. In addition to these advantages, the fact that the pull tab is releasable and the wrist strap is fixed only in some parts means that the ski pole can be allowed to hang from the glove in such a way that it cannot be lost, and thus the skier or hiker is capable of also grasping some other article with the same hand.

With present invention convenient manipulation of the pull tab on releasing it from or reconnecting to the loop part is achieved.

Advantageous features regarding how the loop part is affixed to the glove are obtained from the present invention. For instance, this assures that both adjusting the loop part and releasing the ski pole grip from the glove can be done quickly and simply. Moreover, the ski pole grip can be disposed far enough away from the glove.

A preferred feature of the binding element that connects the pull tab or the wrist strap to the ski pole grip is obtained from the present invention. What is essential here is the detent protrusion, which is provided on the binding element and can latch in the ski pole grip when it is inserted therein. The release can then be accomplished either passively with the aid of a so-called safety release, in other words in response to tensile stress on the pole, or intentionally, with the aid of an actuation lever provided on the ski pole grip.

Further details of the present invention can be learned from the ensuing description, in which the present invention is described and explained in further detail in terms of the exemplary embodiment shown in the drawing.

DESCRIPTION OF THE PREFERRED EMBODIMENT

Figure 1:
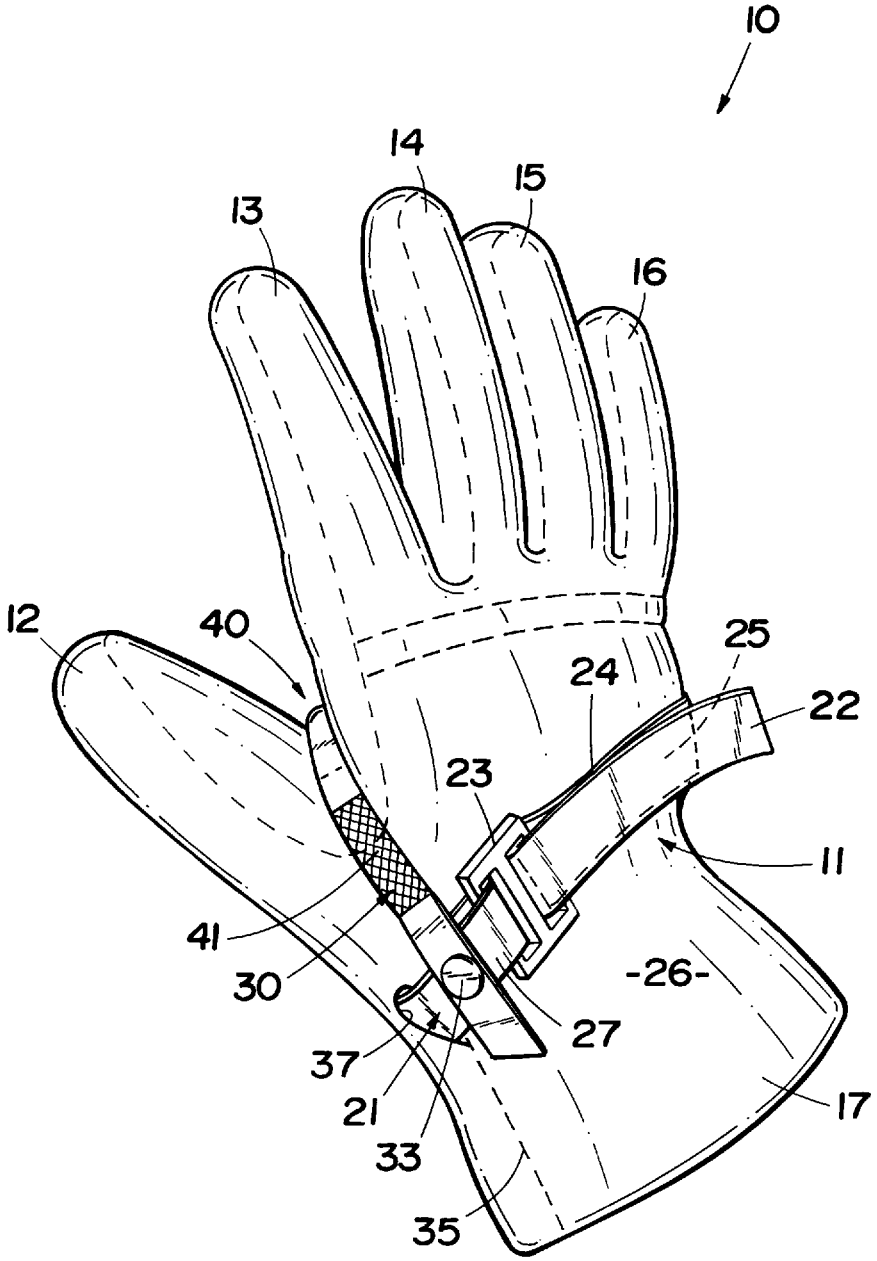
FIG. 1, is a perspective back view of a glove with a wrist strap in accordance with a preferred exemplary embodiment of the present invention.

The glove 10 shown in the drawing in terms of a preferred exemplary embodiment has an integrated wrist strap 11, which is suitable for connection to poles and sticks, such as ski poles, hiking sticks, cross-country poles, walking sticks, and the like. The glove 10, which in this case is embodied as a true glove, with fingers, but may also be a mitten, has a thumb part 12, an index finger part 13, a middle finger part 14, a ring finger part 15, and a little finger part 16, as well as a main or shank part 17 that joins together these finger parts 12-16 and extends over the wrist of a user.

The wrist strap 11 has a loop part 21, which encompasses the shank part 17 of the glove 10 and is embodied to be adjustable in length. The adjustability of the circumferential length of the wrist strap 11 or loop part 21 is achieved in such a way that a free end 22 of the loop part 21 is pulled through a buckle 23, then turned backward again, and attached releasably to the opposite region 25 of the loop part 21 via a Velcro arrangement 24. This arrangement 22–25 for adjusting the circumferential length of the loop part 21 is located on the outside of the glove, where it extends freely over the upper surface 26 of the glove 10 in a straight line, ascending obliquely. The upper surface 26 defines a palm side, a back side a wrist part and the thumb joint part 12 of the glove.

On the palm side of the glove, an attachment part 31 of the wrist strap 11 is permanently joined to the loop part 21, and a pull tab 30 can be connected to it on the outside of the glove in an easily released way. The pull tab 30 and the attachment part 31 are joined together on their respective ends remote from the loop part 21 via a binding element 32, which serves to provide a releasable connection to a ski pole grip 18 shown in FIG. 4. The glove 10 has two casings 37 and 38 on the palm side, each of which begins at a respective narrow side 35 or 36 of the glove 10 and leads to a region 39 on the palm side of the glove 10, near the region of the thumb joint. The one casing 37 begins in a region of the shank 17 below the thumb part 12 and extends in a curve to the aforementioned palm region 39, while the other casing 38 begins at the level of this palm region 39 and extends obliquely downward, approximately in a straight line. The two casings 37 and 38 have their openings on the palm side located next to one another in the region 39, while the respective openings on the outside are located on the narrow side 35 of the glove toward the index finger and the narrow side 36 of the glove toward the little finger, respectively. The applicable region of the loop part 21 extends inside the casings 37 and 38, and as a result the wrist strap 11 is affixed solely to the palm side of a glove. The loop part 21 can be passed through the casings 37 and 38 in such a way that it is either fastened to the glove 10 or extends freely. Adjacent the inner openings of the casings 37 and 38, the attachment part 31 is secured to the loop part 21. In the exemplary embodiment shown, the casings 37 and 38 are formed by covering the applicable palm region with a cover layer, which for instance is stitched to the upper surface 26 of the shank 17 of the glove 10.

The pull tab 30, which is joined permanently to the binding element 32 on one end and on the other end is secured to the loop part in an easily released way, extends in a region of the narrow side 35 of the glove 10 toward the index finger part from the releasable fastening to the loop part 21 as far as a region 40 between the thumb part 12 and the index finger part 13 of the glove. The pull tab 30 is embodied elastically over either part or all of its length. In the exemplary embodiment shown, a rubber-elastic piece 41 is inserted into the pull tab 30. In the exemplary embodiment, the releasable fastening between the pull tab 30 and the loop part 21 is accomplished with the aid of a snap or gripper arrangement 33; the part of the snap or gripper arrangement 33 that is located on the loop part 21 protrudes from the outward-facing side thereof, on the end 27 of the loop part 21 that holds the buckle 23. In the closed position of the wrist strap 11, shown in FIGS. 1–3, the binding element 32 extends in the extension of the pull tab 13, between the two finger parts 12 and 13 in the region 40 of the glove, and is disposed so that it extends somewhat obliquely compared with the position of the two finger parts 12 and 13.

Figure 3:
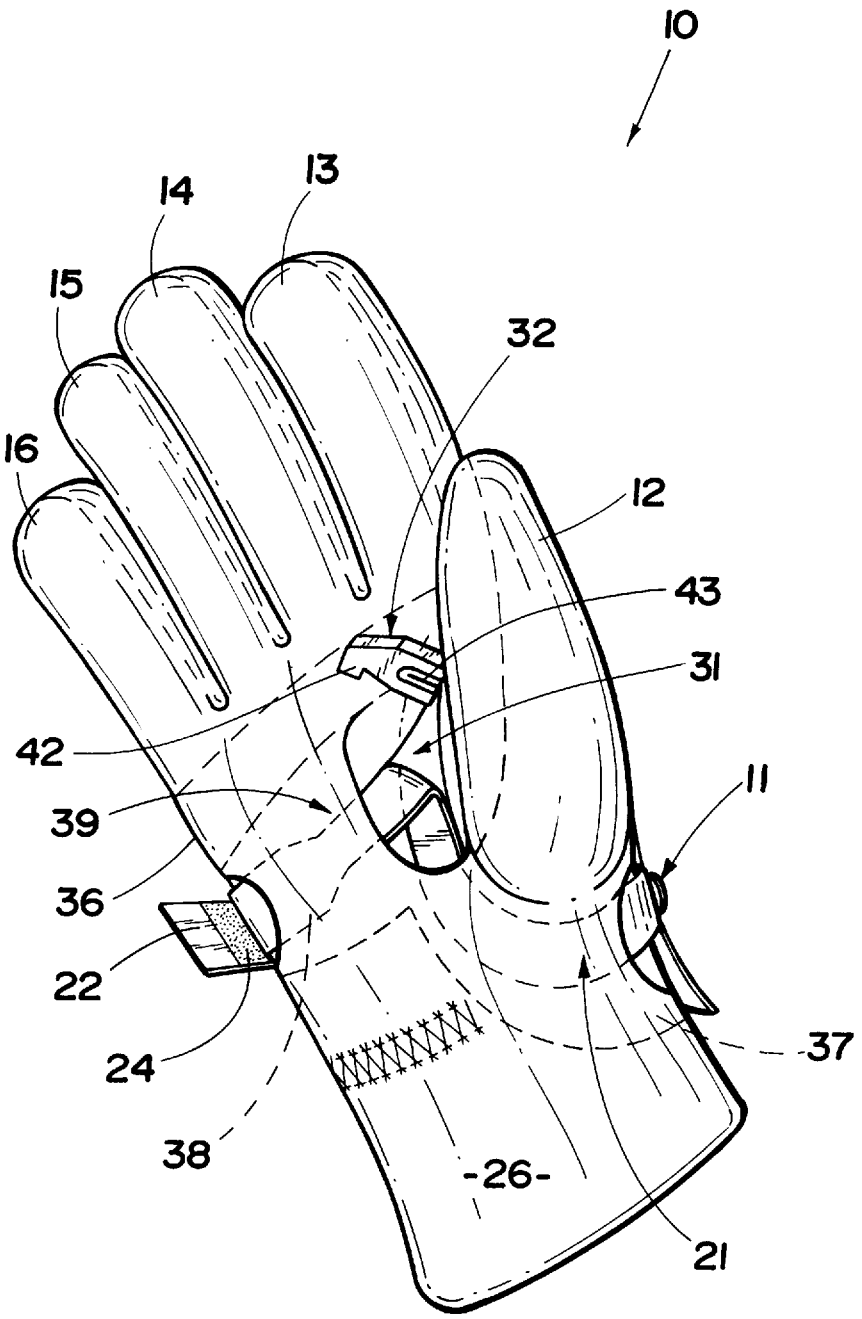
FIG. 3, is a perspective view of the palm side of the glove of FIG. 1.

As can be seen from FIG. 3, the binding element 32 is embodied in the manner of a strap; on its back side, it has a groove 43, into which the applicable ends of the pull tab 30 and the attachment part 31 are inserted and in which they are firmly retained, for instance with a screw fastening or pin. The other front end of the binding element 32 has a detent protrusion 42, with which the binding element 32, in a manner not shown in detail, latchingly engages the ski pole grip 18, or the recess thereof. The binding element 32 can be latched releasably inside the grip 18, which can be done either passively via a safety tripping device, or intentionally via an actuating element 44 on the ski pole grip 18.

Figure 2:
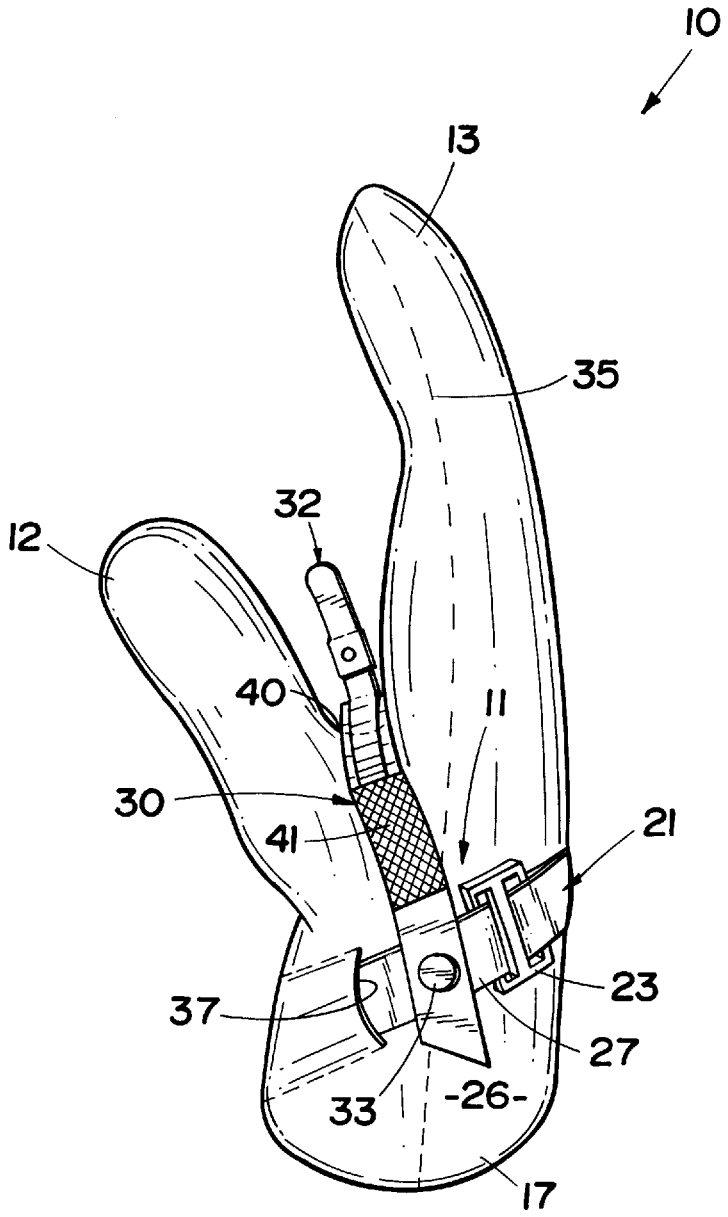
FIG. 2, is a perspective side view of the glove of FIG. 1.

Once the wrist strap 11 is closed in the manner shown in FIGS. 1–3 and suitably retained on the glove 11, then with the binding element 32 inserted into the ski pole grip 18 a tight, firm, non-slip hold of the glove 10 on the ski pole grip 18 is the result. In this position, however, because of the elastic embodiment of the pull tab 30, not only is a close contact of the glove 10 with the ski pole grip 18 in the so-called normal position obtained but also the possibility is afforded that the user can support himself with his glove 10 on the head end of the ski pole grip 18 and thus can put his hand over the grip and brace himself on it.

Figure 4:
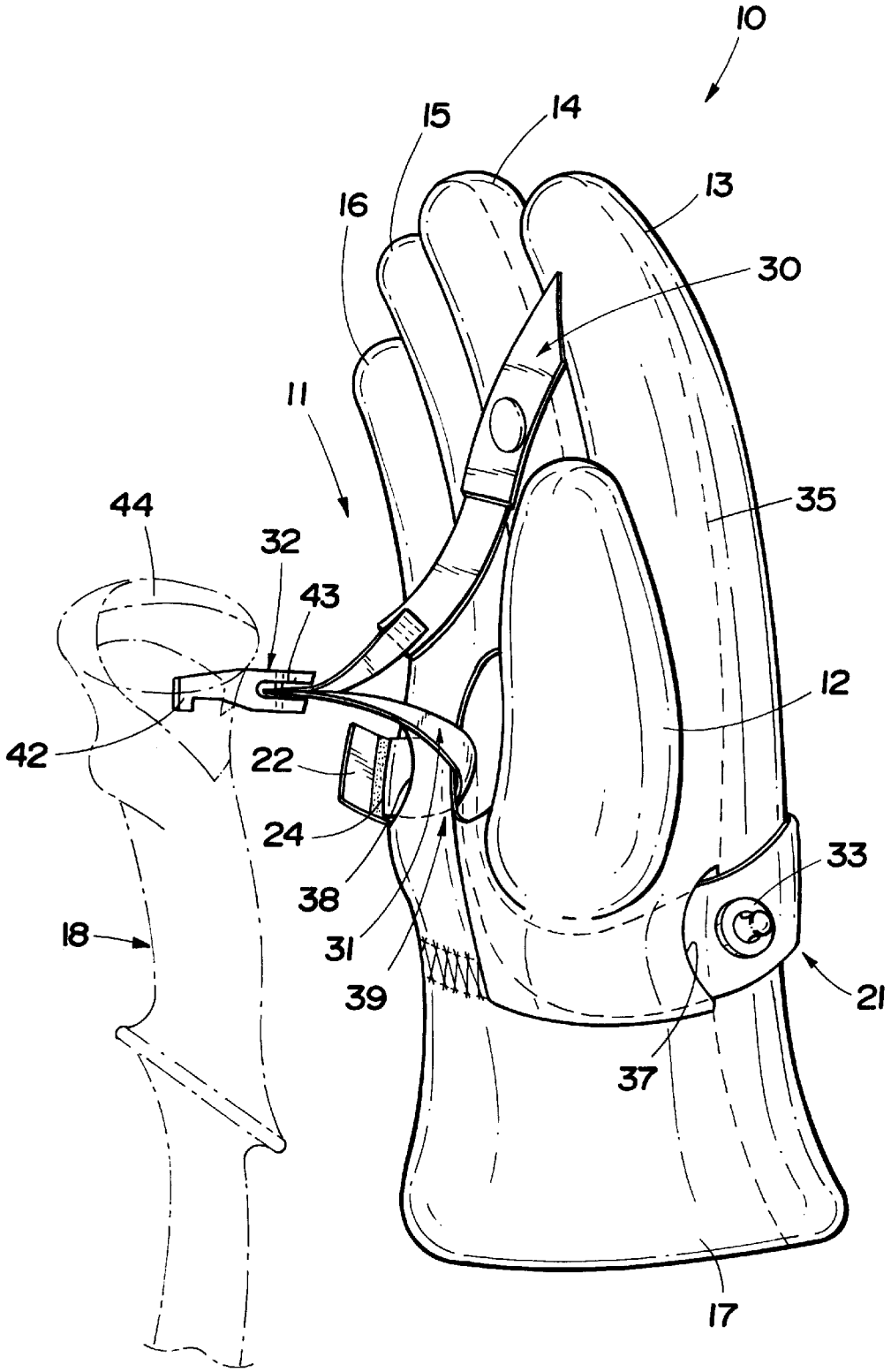
FIG. 4, is a perspective view of the glove similar to FIG. 3, but with the wrist strap released and with the ski pole grip held in captive fashion.

FIG. 4, by comparison, shows the wrist strap 11 joined to a ski pole grip 18, but in such a way that the pull tab 30 is released from the loop part 21. The ski pole grip 18 is held captive by the wrist strap 11 and can be suspended from the glove 10 or swing freely in such a way that the user can grasp other articles with his glove 10. This is attained on the one hand by providing that the pull tab 30 is released from the loop part 21 and on the other that the pull tab 30 and the attachment part 31 can essentially come completely free of the glove as far as the point it is fastened on the palm side to the loop part 21. To that end, it is understood that the inner openings of the casings 37 and 38 can be suitably reinforced.

I claim:

1. A glove with an integrated wrist strap for poles, comprising:

an upper surface defining a palm side, a back side, a wrist part and a thumb joint part;

a binding element for securing the glove to the pole; and a wrist strap formed integrally with the glove, said wrist strap including: a circumferentially adjustable loop part that wraps around said wrist part; an attachment part extending on said palm side of the glove in the region of said thumb joint part; and a pull tab extending on the outside of the glove, said binding element being attached to said attachment part and said pull tab, said binding element and said attachment part and pull tab located adjacent said thumb joint part on said palm side of the glove, wherein said pull tab is embodied as at least partly elastic and secured releasably to said upper surface.

2. The glove as defined in claim 1, wherein said upper surface further defines two spaced apart narrow des of the glove, with said thumb joint part extending from one of said spaced apart narrow sides, wherein said circumferentially adjustable loop part has a length adjustment region which is disposed on said upper surface to extend freely between said two spaced apart narrow sides, and wherein said pull tab is releasably secured to said loop part.

3. The glove as defined in claim 2, wherein said loop part extends obliquely between said two spaced apart narrow sides.

4. The glove as defied in claim 1, wherein said pull tab is releasably secured outside said adjustment region of said loop part.

5. The glove as defined in claim 4, wherein said loop part and said pull tab form a fastening region at which said binding element is located, said fastening region being disposed in the region of one of said spaced part narrow sides adjacent said thumb joint part.

6. The glove as defined in claim 4, wherein said upper surface further defines an index finger part, and wherein said loop part and said pull tab form a fastening region, said fastening region being disposed in the region of one of said spaced apart narrow sides adjacent said index finger part.

7. The glove as defined in claim 1, wherein said loop part is affixed to the glove solely on said palm side.

8. The glove as defined in claim 1, wherein said upper surface further defines casings which provide accesses for affixing said wrist strap to the glove.

9. The glove as defined in claim 8, wherein said casings each have an opening in the region of a respective narrow side, with the openings on said palm side being located directly next to one another.

10. The glove as defined in claim 9, wherein adjacent open ends of said casings are disposed near said thumb joint region.

11. The glove as defined in claim 8, wherein said casings are formed by a cover layer permanently attached to the glove.

12. The glove as defined in claim 8, wherein one of said casings extends in a curved fashion, and the other of said casings extends in a straight line, ascending obliquely.

13. The glove as defined in claim 1, wherein said binding element includes a detent protrusion for latching in said binding element in the grip of a pole.

14. The glove as defined in claim 13, wherein said binding element can be released from the grip of the pole by tensile stress.

15. The combination of a glove and a pole, the pole having a grip including an actuating member, the glove comprising:

an upper surface defining a palm side, a back side, a wrist part and a thumb joint part;

a binding element for securing the glove to the pole, said binding element being releasably secured to said pole by said actuating member; and a wrist strap formed integrally with glove, said wrist strap including: a circumferentially adjustable loop part that wraps around said wrist part; and attachment part extending on said palm side of the glove in the region of said thumb joint part; and a pull tab extending on the outside of the glove, said binding element being attached to said attachment part and said pull tab, said binding element and said attachment part and pull tab located adjacent said thumb joint part on said palm side of the glove, wherein said pull tab is embodied as at least partly elastic and secured releasably to said upper surface.

* * * * *